US008899777B2

(12) United States Patent
Uke et al.

(10) Patent No.: US 8,899,777 B2
(45) Date of Patent: Dec. 2, 2014

(54) METHODS AND DEVICES THAT EMPLOY THERMAL CONTROL OF CURRENT TO ELECTRICAL COMPONENTS

(75) Inventors: Alan K. Uke, Del Mar, CA (US); Elmer Frederick Fischer, San Diego, CA (US); David M. Giuntoli, San Diego, CA (US); Richard H. Gunderson, Santee, CA (US)

(73) Assignee: Underwater Kinetics, LLPCA (US)

( * ) Notice: Subject to any disclaimer, the term of this patent is extended or adjusted under 35 U.S.C. 154(b) by 0 days.

(21) Appl. No.: 11/788,766

(22) Filed: Apr. 19, 2007

(65) Prior Publication Data

US 2009/0016047 A1 Jan. 15, 2009

Related U.S. Application Data

(60) Provisional application No. 60/793,420, filed on Apr. 19, 2006.

(51) Int. Cl.

| | |
|---|---|
| ***F21L 4/00*** | (2006.01) |
| ***F21L 4/04*** | (2006.01) |
| ***F21V 29/00*** | (2006.01) |
| ***F21L 4/02*** | (2006.01) |
| ***F21V 23/04*** | (2006.01) |
| *F21Y 101/02* | (2006.01) |

(52) U.S. Cl.

CPC ..... *F21V 23/0414* (2013.01); *F21L 4/027* (2013.01); *F21V 29/004* (2013.01); *F21Y 2101/02* (2013.01)

USPC ..... 362/157; 362/204; 362/205; 362/208; 362/294

(58) Field of Classification Search

USPC ..... 362/157, 204, 205, 208, 296, 294; 315/55–59

See application file for complete search history.

(56) References Cited

U.S. PATENT DOCUMENTS 4,224,658 A * 9/1980 Siiberg ..... 362/183
6,127,784 A * 10/2000 Grossman et al. ..... 315/159

(Continued)

FOREIGN PATENT DOCUMENTS

EP 0891120 A2 1/1999
JP 2004-214519 A 7/2004

(Continued)

*Primary Examiner* — David J Makiya

(74) *Attorney, Agent, or Firm* — Acuity Law Group, P.C.; Daniel M. Chambers

(57) ABSTRACT

Methods and devices are described that use one or more thermally responsive current-controlling elements to regulate current flow to an electrical component, particularly a light source such as an LED. Examples of such thermally responsive current-controlling elements include thermistors, inductors, and capacitors. for treating conditions or disorders which can be alleviated by reducing food intake are disclosed which comprise administration of an effective amount of a purine analog, alone or in conjunction with other compounds or compositions that affect satiety. The methods are useful for treating conditions or disorders wherein appetite reduction would be beneficial, including obesity and binge-eating disorder. Pharmaceutical compositions for use in the methods of the invention are also disclosed.

14 Claims, 4 Drawing Sheets

(56) References Cited

U.S. PATENT DOCUMENTS

| | | | | |
|---|---|---|---|---|
| 6,242,870 | B1 * | 6/2001 | Koyanagi et al. | 315/291 |
| 6,296,367 | B1 * | 10/2001 | Parsons et al. | 362/183 |
| 6,943,698 | B2 * | 9/2005 | Jones et al. | 340/907 |
| 7,124,592 | B2 | 10/2006 | Tanaka | |
| 7,345,320 | B2 | 3/2008 | Dahm | |
| 7,633,037 | B2 * | 12/2009 | Hoffman | 219/502 |
| 2004/0120156 | A1 * | 6/2004 | Ryan | 362/373 |
| 2004/0190285 | A1 | 9/2004 | Galli | |
| 2006/0039139 | A1 * | 2/2006 | Maglica et al. | 362/202 |
| 2006/0103320 | A1 * | 5/2006 | Janning | 315/164 |
| 2007/0058366 | A1 * | 3/2007 | West | 362/208 |
| 2008/0002407 | A1 * | 1/2008 | Chen | 362/276 |

FOREIGN PATENT DOCUMENTS

| | | | |
|---|---|---|---|
| JP | 2005-347434 | A | 12/2005 |
| WO | 2004/068909 | A1 | 8/2004 |
| WO | 2007/028397 | A2 | 3/2007 |
| WO | 2007/035390 | A2 | 3/2007 |

* cited by examiner

METHODS AND DEVICES THAT EMPLOY THERMAL CONTROL OF CURRENT TO ELECTRICAL COMPONENTS

TECHNICAL FIELD OF THE INVENTION

The present invention relates to electrically powered devices and methods that employ one or more thermally responsive current-controlling elements to regulate current flow to an electrical component, particularly a light source.

BACKGROUND OF THE INVENTION

1. Introduction

The following description includes information that may be useful in understanding the present invention. It is not an admission that any such information is prior art, or relevant, to the presently claimed inventions, or that any publication specifically or implicitly referenced is prior art.

2. Background

Flashlights are popular devices, and have many applications. Traditionally, flashlights have employed an incandescent light bulb as the light source. Recently, flashlights have been introduced that use light emitting diodes (LEDs) as the light source. LEDs offer many advantages over traditional incandescent bulbs, including greater efficiency and durability and a longer useful life. As with traditional flashlights, however, the use of LED-based flashlights is also typically constrained by battery life. Also, the service life of a flashlight's light source, be it an incandescent bulb, LED, or other light source, can be radically affected by operating temperature. Accordingly, improvements in power usage and temperature control would advantageous.

3. Definitions

Before describing the instant invention in detail, several terms used in the context of the present invention will be defined. In addition to these terms, others are defined elsewhere in the specification, as necessary. Unless otherwise expressly defined herein, terms of art used in this specification will have their art-recognized meanings.

A "patentable" composition, process, machine, or article of manufacture according to the invention means that the subject matter satisfies all statutory requirements for patentability at the time the analysis is performed. For example, with regard to novelty, non-obviousness, or the like, if later investigation reveals that one or more claims encompass one or more embodiments that would negate novelty, non-obviousness, etc., the claim(s), being limited by definition to "patentable" embodiments, specifically exclude the unpatentable embodiment(s). Also, the claims appended hereto are to be interpreted both to provide the broadest reasonable scope, as well as to preserve their validity. Furthermore, if one or more of the statutory requirements for patentability are amended or if the standards change for assessing whether a particular statutory requirement for patentability is satisfied from the time this application is filed or issues as a patent to a time the validity of one or more of the appended claims is questioned, the claims are to be interpreted in a way that (1) preserves their validity and (2) provides the broadest reasonable interpretation under the circumstances.

A "plurality" means more than one.

SUMMARY OF THE INVENTION

The objects of this invention include the provision of patentable, electrically powered devices that use one or more thermally responsive current-controlling elements to regulate the flow of electricity from the device's power supply to an electrical component such as a light source. Such devices more efficiently utilize power supplies and also provide for greater service lives of the electrical components to which the supply of electric power is regulated.

Thus, in one aspect, the invention concerns patentable assemblies for inclusion in electrically powered devices. Such assemblies comprise a current-consuming electrical component and at least one thermally responsive current-controlling element in electrical communication with the current-consuming electrical component and positioned to regulate electrical current flowing from the power supply to the current-consuming electrical component. In preferred embodiments, the current-consuming electrical component is a light source, such as one or more light bulbs, optical fibers, and/or LEDs, alone or combination with other light sources. Representative examples of thermally responsive current-controlling elements include temperature-variable inductors and capacitors, and thermistors are particularly preferred. In preferred embodiments of the invention, the thermally responsive current-controlling elements are in thermal communication with the light source, such that heat from the light source can be transferred, directly or through one or more intermediate heat-conducting components, to the thermistor or other thermally responsive current-controlling element.

The light assemblies of the invention can be assembled with other components. In the context of a flashlight, for example, the light assembly can be associated with a component such as a reflector or heat sink. In some embodiments, the reflector also serves as a thermal mass, or heat sink, while in other embodiments, a non-reflective heat sink may be employed. In still other embodiments, a heat sink having one or more reflective elements (i.e., an element that reflects or refracts incident electromagnetic radiation) may be used, alone or in addition to a reflector.

In preferred embodiments of this aspect, the light assembly and reflector, as well as any other associated components (e.g., a lens or lens system) are configured for assembly into, or can otherwise be combined with, a flashlight bezel.

A related aspect of the invention relates to flashlights. Typically, such flashlights include a light assembly according to the invention, a flashlight bezel, and a flashlight body. Any such flashlight, regardless of the particular embodiment, also includes such other components, circuitry, and associated electronics and control logic, if any, as may be required for the device to operate as intended when a suitable power supply is included. Preferred power supplies include one or more rechargeable or non-rechargeable batteries, although the invention contemplates the inclusion or use any suitable portable or fixed DC, AC, or switchable AC/DC power supply to energize the particular light source(s) in the device.

Another aspect relates to methods of illuminating articles or spaces using a flashlight according to the invention. Still another aspects of the invention relate to methods of controlling current use, battery life, levels of light output, extending light source life, etc. through the use of a device, particularly a flashlight, that includes a light assembly according to the invention.

These and other aspects and embodiments of the invention are discussed in greater detail in the sections that follow.

Figure 1A:
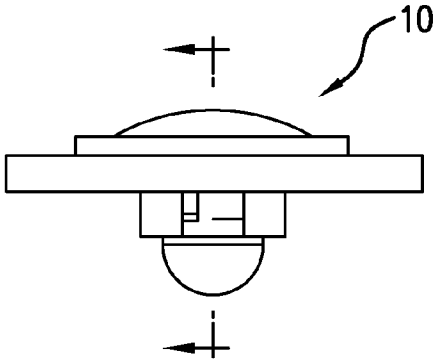
FIG. 1 shows several views, FIG. 1A-FIG. 1E, of a light assembly according to the invention.
Figure 1B:
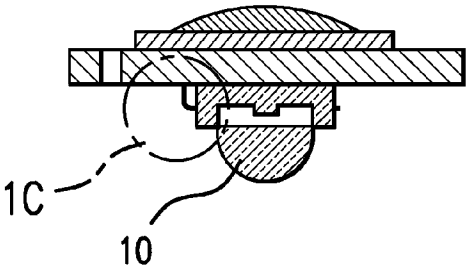
Figure 1C:
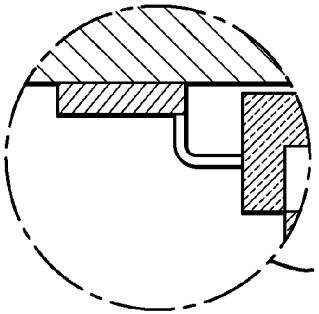
Figure 1D:
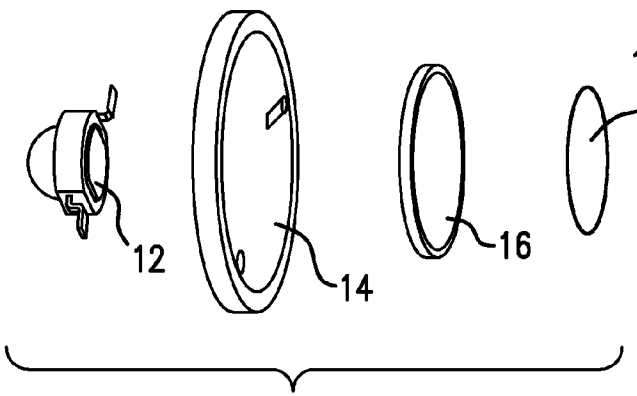
Figure 1E:
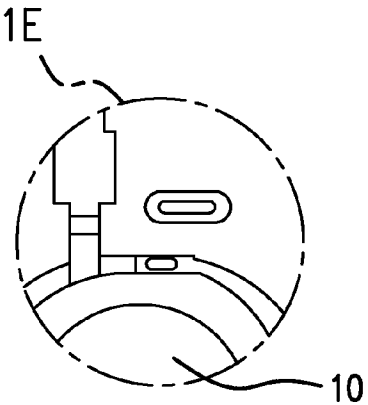
Figure 1F:
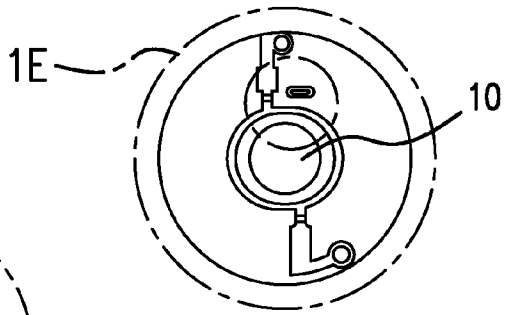
Figure 2D:
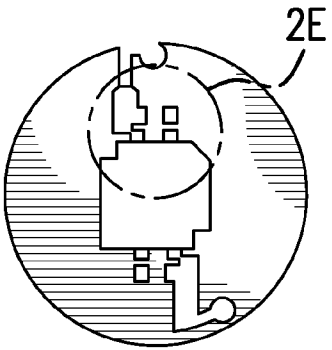
FIG. 2 shows several views, FIG. 2A-FIG. 2F, of a light assembly according to the invention.
Figure 2C:
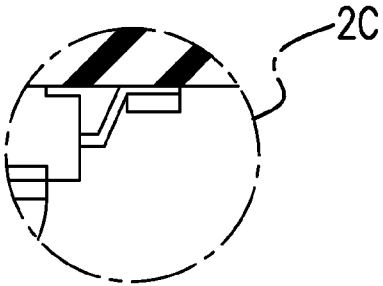
Figure 2E:
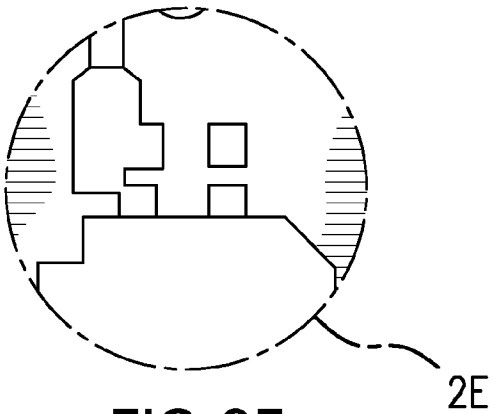
Figure 2B:
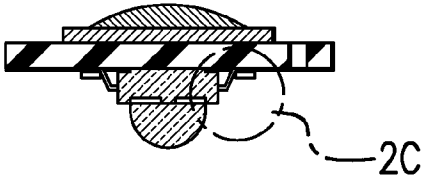
Figure 2A:
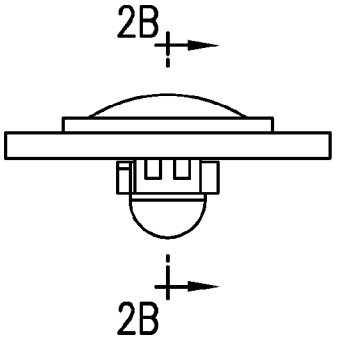
Figure 2F:
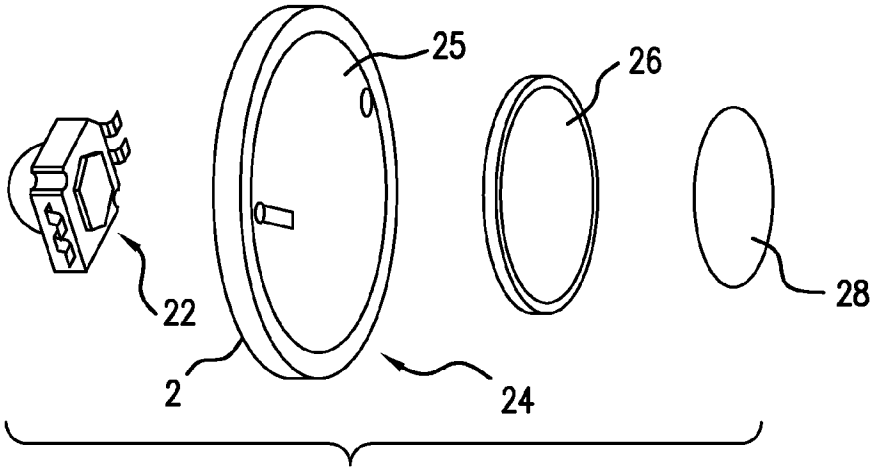
Figure 3C:
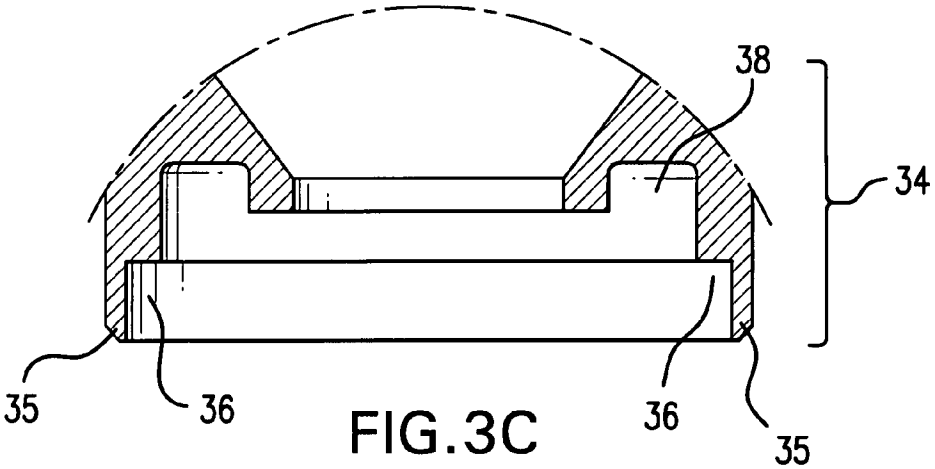
FIG. 3 shows several views, FIG. 3A-FIG. 3D, of a particular flashlight reflector.
Figure 3D:
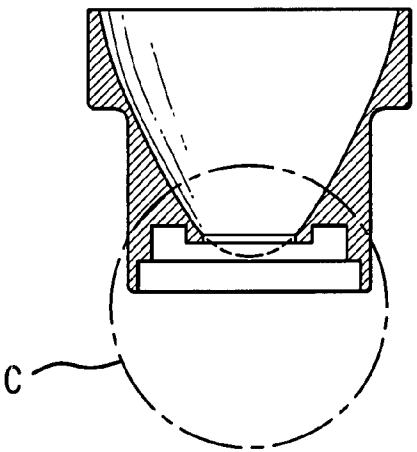
Figure 3A:
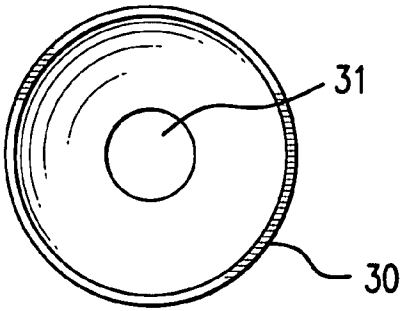
Figure 3B:
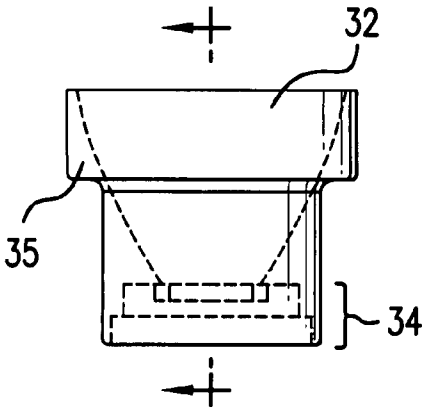

As those in the art will appreciate, the following description describes certain preferred embodiments of the invention in detail, and is thus only representative and does not depict the actual scope of the invention. Before describing the present invention in detail, it is understood that the invention is not limited to the particular assemblies, devices, systems, and methods described, as these may vary. Any suitable circuitry, components, and material now known or later developed can be used to produce the devices of the invention. It is also to be understood that the terminology used herein is for the purpose of describing particular embodiments only, and is not intended to limit the scope of the invention defined by the appended claims.

DETAILED DESCRIPTION OF THE INVENTION

The invention will be further described by reference to the drawings, which are described in detail below. This description shall in no way to be considered to limit the scope of the invention in any manner.

FIG. 1 shows a representative light assembly (10) according to the invention. This assembly (10) includes an LED (12; 3 watt; Luxeon) attached (in this embodiment, via a suitable epoxy) to a printed circuit board (PCB; 14; for a 3 watt LED). The leads of the LED are aligned with conductors that traverse the PCB in order to provide electrical communication between electrical components positioned on or adjacent to the opposite faces of the PCB. A thermistor (16) is attached (in this embodiment, via a suitable electrically conductive solder) via one surface to the PCB surface opposite the PCB surface to which the LED (12) is attached. A suitable electrically conductive solder (18) is also applied, as required, to a portion of the face of the thermistor (16) opposite that facing a surface of the PCB. In this embodiment, the components (12, 14, 16, and 18) are each round, but of different diameters. Here, these components are concentrically aligned when assembled, although such alignment and component shape is not required, merely preferred.

Thermistors are electronic devices that change resistance depending on temperature. They can have linear and non-linear characteristics as well as negative and positive temperature coefficients. Some have a non-linear characteristic such that their resistance stays relatively constant until they reach a "switch temperature". At this point, their resistance increases rapidly with temperature.

When connected in series with a lamp, for example, an electronic light-emitting device such as an LED, and thermally connected to the device, the series current will vary depending on the temperature of the assembly. A positive coefficient thermistor can be used to decrease the current as the assembly warms up. A thermistor with a switching characteristic can be used to regulate the temperature of such an assembly quite accurately.

In the context of LEDs, an LED is believed to heat up due to inefficiencies associated with light generation. The power loss associated with these inefficiencies can be expressed as heat. Depending on the particular embodiment, there is a limit to the allowable temperature of the junction of the LED and thermistor. To protect the LED, the temperature should be maintained below that temperature. By reducing the current flowing to the LED, in many embodiments the thermistor controls, and preferably reduces, the heat increase.

As will be appreciated, a particular assembly will reach a temperature equilibrium depending on factors such as heat loss, the absolute temperature of the assembly, and the heat introduced into the assembly during light emission as a result of the inefficiencies of the LED. In general, the heat introduced into the assembly comes from the $I^2R$ losses. Thus, holding constant the other parameters that influence the temperature equilibrium of the particular assembly, decreasing current should decrease the temperature, and the temperature is maintained at a value where these factors are in balance. In such embodiments, the negative feedback is provided by the thermistor.

Choosing a suitable thermistor depends on various factors, including the particular application, the type of light source, the desired amount of light to be emitted, etc., and is well within the ordinary skill of the art. In certain preferred embodiments, the thermistor allows use of a higher series current when the light assembly is cold and able to withstand more power, resulting in brighter light when the assembly is cold. When the temperature rises, the thermistor reduces the current flowing to the lamp(s) of the light assembly, thereby protecting the light source, which preferably is one or more LEDs, As those in the art will appreciate, selecting a thermistor with the desired nominal value for the particular application will protect the LED from too much initial current. Also, regulating the temperature of the assembly allows regulation of the current.

At equilibrium, the current is constant regardless of the voltage, provided the voltage does not exceed the maximum allowed for the particular components. Higher voltages will increase the amount of current until the light source, preferably one or more LEDs, heats up.

Heating of the assembly will decrease the current as the thermistor's resistance increases. As the voltage decreases, the temperature will decline, thereby reducing resistance, which, in turn, increases the current until equilibrium is once again established.

As compared to electrically powered devices that employ, for example, a battery circuit using a series resistor instead of a thermally responsive current-controlling element (e.g., a thermistor) and in which current, and hence light output, typically decrease as the voltage of the battery decreases and where initially high voltages could damage or stress a light source, e.g., an LED, in a device that employs a thermally responsive current-controlling element such as a thermistor, as the voltage decreases, the current, and therefore the light output, essentially remains constant until the batteries are depleted.

FIG. 2 shows another representative light assembly (20) according to the invention, which assembly is similar to that depicted in FIG. 1. In FIG. 2, light assembly (20) also comprises an LED (22; Luxeon, part LXK2-PW14-U00) bonded via epoxy to the upper face (23) of PCB (24). A thermistor (26) is attached (in this embodiment, via a suitable electrically conductive solder) to the lower face (25) of the PCB (24), and a suitable electrically conductive solder (28) is also applied, as required to provide electrical connectivity (i.e., electrical communication) with a terminal of a battery within the power supply (not shown), to a portion of the face of the thermistor (26) opposite that facing the lower face (25) of the PCB (24).

FIG. 3 shows several views of a representative flashlight reflector (30) for use in practicing certain embodiments of the invention. View A is a top down view, which clearly shows the hole (31) in the bottom of the reflector through which a light source, such as the LED shown in the light assemblies depicted in FIGS. 1 and 2 (12 and 22, respectively), can be disposed when associated with the reflector (30). This reflector (30) has a parabolic curve to achieve a desired focal length. View B is a side view of the reflector (30) taken through the plane defined by the concentric diameters of the reflector's hole (31) and widest opening (32). Also shown is the apron (33) of the reflector (30) that engages an inner surface of a bezel (not shown). The parabolic shape of the reflector is clearly visible in this view, as it is in View D, as well. Also visible here is the portion at the bottom of the reflector intended to engage and retain a light assembly as shown in FIGS. 1 and 2 (12 and 22, respectively), an enlarged cut-away view of which is shown in View C. As shown in View C, the lower portion (34) of the reflector (30) is machined to contain downward-extending lip (35) that defines a volume capable of accepting the PCB (14 or 24). The outer rim of the PCB (not shown) rests on the PCB base (36).

Figure 4C:
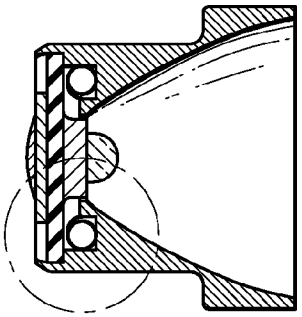
FIG. 4 shows several views, FIG. 4A-FIG. 4D, of a light assembly of FIG. 1 or 2 attached to a reflector as shown in FIG. 3.
Figure 4D:
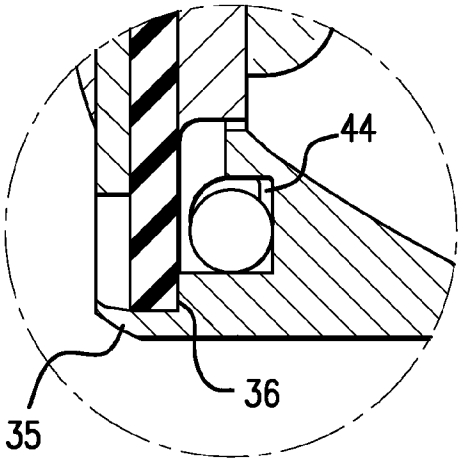
Figure 4B:
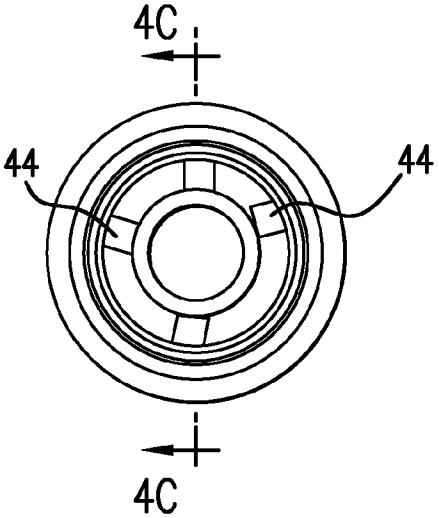
Figure 4A:
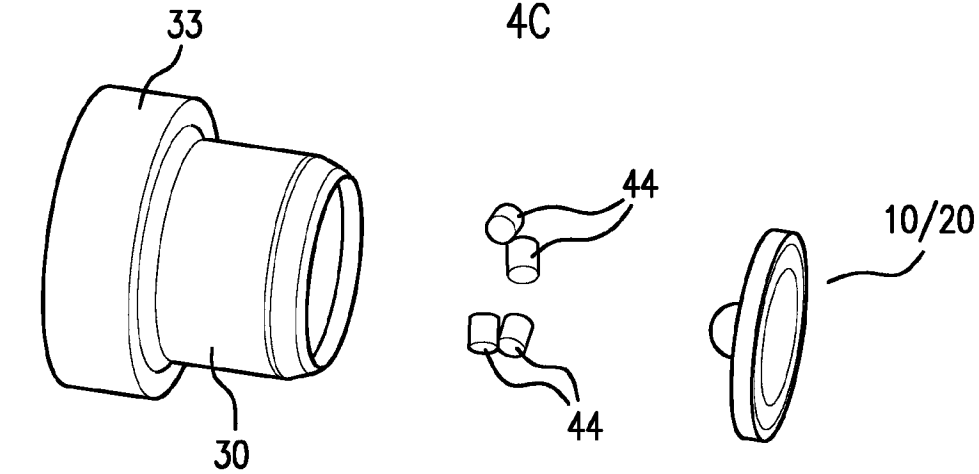

FIG. 4(A) shows an exploded view of a flashlight reflector (30, as depicted in FIG. 3) assembled with a light assembly (10 or 20). Catalyst pellets (44), designed to absorb gases released from the batteries of the power supply (not shown) during flashlight operation, are spaced about in a groove (38) machined into the lower portion of the reflector (30). In this embodiment, the light assembly is retained in the reflector by swaging the lip (35) of the reflector (30) using a suitable tool adapted for this purpose. Prior to swaging the light assembly to the reflector, several catalyst pellets (44) are loosely placed into the groove (38).

The flashlight reflector and light assembly depicted in FIG. 4 can be assembled into a suitable bezel adapted to receive these items. The bezel preferably will contain a lens or lens system. The bezel may be assembled with a complementary flashlight body. The bezel may be attached or otherwise associated with the flashlight body using any suitable mating configuration, for example, a threaded male portion on a flashlight body adapted to receive a complementary female threaded portion of the flashlight. The flashlight body and bezel can be made of any suitable material, including metals and plastics. Particularly preferred are thermoplastics molded into the desired shapes. Preferably, the flashlight body will also contain a chamber for housing the power supplied, which in many embodiments will comprise one or more removable batteries.

All patents, patent applications, and publications mentioned in the specification are indicative of the levels of those of ordinary skill in the art to which the invention pertains. Each patent, patent application, and publication cited herein is hereby incorporated by reference in its entirety for all purposes regardless of whether it is specifically indicated to be incorporated by reference in the particular citation.

All of the compounds, compositions, and methods disclosed and claimed herein can be made and executed without undue experimentation in light of the present disclosure. Moreover, it is intended to obtain rights which include alternative and/or equivalent embodiments to the extent permitted, including alternate, interchangeable, and/or equivalent structures, functions, ranges, or steps to those claimed, whether or not such alternate, interchangeable and/or equivalent structures, functions, ranges, or steps are disclosed herein, and without intending to publicly dedicate any patentable subject matter, as it is intended that all patentable subject matter disclosed herein eventually be the subject of patent claims.

The terms and expressions which have been employed are used as terms of description and not of limitation, and there is no intention that in the use of such terms and expressions of excluding any equivalents of the features shown and described or portions thereof, but it is recognized that various modifications are possible within the scope of the invention claimed. Also, the invention illustratively described herein suitably may be practiced in the absence of any element(s) not specifically disclosed herein. Thus, for example, in each instance herein any of the terms "comprising", "consisting essentially of", and "consisting of" may be replaced with either of the other two terms. Furthermore, while the compositions and methods of this invention have been described in terms of preferred embodiments, it will be apparent to those of skill in the art that variations may be applied to the compositions and methods and in the steps or in the sequence of steps of the method described herein without departing from the spirit and scope of the invention. Thus, it should be understood that although the present invention has been specifically disclosed by preferred embodiments and optional features, modification and variation of the concepts herein disclosed may be resorted to by those skilled in the art, and that such modifications and variations are considered to be within the scope of this invention as defined by the appended claims.

What is claimed is:

1. A patentable light assembly, consisting essentially of an electrically powered light source; and a thermally responsive current-controlling element in electrical communication and in series with the light source and positioned to itself regulate electrical current flowing to the light source, wherein the thermally responsive current-controlling element is selected from the group consisting of a thermistor, a temperature-variable inductor, and a temperature-variable capacitor.

2. A light assembly according to claim 1 that comprises at least one light source selected from the group consisting of an LED, an incandescent light bulb, an optical fiber, and a combination of any one or more of the foregoing.

3. A light assembly according to claim 1 wherein the light source comprises at least one LED, and optionally a plurality of LEDs.

4. A light assembly according to claim 1 wherein the thermally responsive current-controlling element is a thermistor.

5. A light assembly according to claim 4 wherein the thermally responsive current-controlling element is in thermal communication with the light source.

6. A light assembly according to claim 1 wherein a heat sink element is disposed between, and is in thermal communication with each of, the light source and the thermally responsive current-controlling element.

7. A light assembly according to claim 6 that comprises at least one light source selected from the group consisting of an LED, an incandescent light bulb, an optical fiber, and a combination of any one or more of the foregoing.

8. A light assembly according to claim 6 wherein the light source comprises at least one LED, and optionally a plurality of LEDs.

9. A light assembly according to claim 6 wherein the thermally responsive current-controlling element is a thermistor.

10. A light assembly, consisting essentially of an electrically powered light source; and a thermally responsive current-controlling element in electrical communication and in series with the light source and positioned to itself regulate electrical current flowing to the light source, wherein the thermally responsive current-controlling element is selected from the group consisting of a thermistor, a temperature-variable inductor, and a temperature-variable capacitor, wherein the light assembly is housed in a reflector or heat sink, wherein the heat sink may optionally comprise one or more reflective elements.

11. A light assembly according to claim 10 wherein the light assembly and reflector are configured for positioning in a flashlight bezel, optionally in association with a lens.

12. A flashlight, comprising:

a light assembly, consisting essentially of an electrically powered light source; and a thermally responsive current-controlling element in electrical communication and in series with the light source and positioned to itself regulate electrical current flowing to the light source, wherein the thermally responsive current-controlling element is selected from the group consisting of a thermistor, a temperature-variable inductor, and a temperature-variable capacitor, a flashlight bezel in which the light assembly is disposed, which bezel is adapted for attachment to a flashlight body; and a flashlight body.

13. A flashlight according to claim 12 further comprising a power supply housed in the flashlight body and in electrical communication with the light assembly.

14. A flashlight according to claim 12 wherein the power supply comprises one or more batteries.

* * * * *